US008668088B2

(12) United States Patent
Donnelly

(10) Patent No.: US 8,668,088 B2
(45) **Date of Patent: *Mar. 11, 2014**

(54) SANITARY CANDLE COVERS FOR CAKES AND CUPCAKES

(71) Applicant: Brian Donnelly, East Northport, NY (US)

(72) Inventor: Brian Donnelly, East Northport, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/897,831

(22) Filed: May 20, 2013

(65) Prior Publication Data

US 2013/0248402 A1 Sep. 26, 2013

Related U.S. Application Data

(63) Continuation-in-part of application No. 13/430,194, filed on Mar. 26, 2012, now Pat. No. 8,459,456.

(60) Provisional application No. 61/468,628, filed on Mar. 29, 2011, provisional application No. 61/475,302, filed on Apr. 14, 2011.

(51) Int. Cl.
*B65D 73/00* (2006.01)

(52) U.S. Cl.
USPC ..... 206/457; 431/295

(58) Field of Classification Search
USPC ..... 206/457, 459.5, 499, 223, 508, 519, 206/521
See application file for complete search history.

(56) References Cited

U.S. PATENT DOCUMENTS

| | | | |
|---|---|---|---|
| 1,125,855 | A | 1/1915 | Mapes |
| 1,511,004 | A | 10/1924 | Pooch |
| 1,778,597 | A | 10/1930 | Herzog |
| 1,879,477 | A | 9/1932 | Powell |
| 1,982,723 | A | 12/1934 | Bantleon |
| 2,303,540 | A | 6/1940 | Montgomery |
| 2,393,767 | A | 1/1946 | Gould |
| 2,406,777 | A | 9/1946 | Koretzky |
| 2,468,505 | A | 4/1949 | Mineill |
| D157,043 | S | 1/1950 | Gruber |
| 2,617,350 | A | 11/1952 | Shol |
| 2,758,458 | A | 8/1956 | Carlson |
| D183,456 | S | 9/1958 | Henderson |
| 2,852,054 | A | 9/1958 | Motely |
| 2,960,770 | A | 11/1960 | Valenta |
| 2,997,788 | A | 8/1961 | Gilbert |
| 3,076,577 | A | 2/1963 | Craig |

(Continued)

FOREIGN PATENT DOCUMENTS

| | | | |
|---|---|---|---|
| FR | 2592782 | A1 | 7/1987 |
| WO | 2009111821 | A1 | 9/2009 |

*Primary Examiner* — Steven A. Reynolds
*Assistant Examiner* — Ernesto Grano
(74) *Attorney, Agent, or Firm* — Alfred M. Walker

(57) ABSTRACT

A sanitary cake cover with a removable candle deck, which protects the contents of the cake from contamination during blowing out of celebratory candles. The transparent cake cover includes a removable candle deck for at least one candle, which does not pierce the cake or cover being decorated by lighted celebratory candles. The cake cover can be used without the candle deck. The sanitary cake cover is impervious to assault by normal airborne contaminants, such as dust and dirt as well from contaminated expelled breath during the act of blowing out candles. The separate removable candle deck is removable to enable the container to be used for other food items without the obstruction of candle recesses. The flat top of the cover has a peripheral top ridge forming a flat central depression of dimensions to fit the flat candle deck.

18 Claims, 16 Drawing Sheets

(56) References Cited

U.S. PATENT DOCUMENTS

| | | | |
|---|---|---|---|
| 3,204,359 | A | 9/1965 | Kurokawa |
| 3,736,214 | A | 5/1973 | McBirnie |
| 3,819,455 | A | 6/1974 | MacKendrick |
| 4,206,845 | A | 6/1980 | Christian |
| 4,219,119 | A | 8/1980 | Zefran |
| 4,359,159 | A | 11/1982 | Pollard |
| 4,385,554 | A | 5/1983 | Daenen |
| 4,663,506 | A | 5/1987 | Bowen et al. |
| 4,721,455 | A | 1/1988 | Barfus |
| 4,884,966 | A | 12/1989 | Wexler |
| 4,938,688 | A | 7/1990 | Wexler |
| 5,096,274 | A | 3/1992 | Fuschetto |
| D333,410 | S | 2/1993 | Panzarello |
| 5,582,478 | A | 12/1996 | Ambrosino |
| 5,673,802 | A | 10/1997 | Valentino |
| D446,083 | S | 8/2001 | Marsh |
| D455,850 | S | 4/2002 | Haskin |
| 6,607,377 | B2 | 8/2003 | Latzel |
| D490,276 | S | 5/2004 | Pereira |
| 6,736,632 | B2 | 5/2004 | Wolter |
| D572,539 | S | 7/2008 | Swinford et al. |
| D584,926 | S | 1/2009 | Ethier |
| 8,056,751 | B2 | 11/2011 | Vovan |
| 8,307,982 | B1 | 11/2012 | Vovan |
| 2003/0136277 | A1 | 7/2003 | Okros |
| 2004/0224271 | A1 | 11/2004 | Langsam |
| 2004/0244604 | A1 | 12/2004 | Slagter |
| 2005/0056162 | A1 | 3/2005 | Milligan |
| 2005/0087459 | A1 | 4/2005 | Slagter |
| 2006/0115781 | A1 | 6/2006 | Greiner |
| 2006/0130677 | A1 | 6/2006 | Chou |
| 2007/0048680 | A1 | 3/2007 | Cartledge |
| 2009/0181335 | A1 | 7/2009 | Tropeano |

15
12
5
5a
5b
9
17
12
9
18
16
18a
7
8
24
19
Happy Birthday
20

Fig. 6
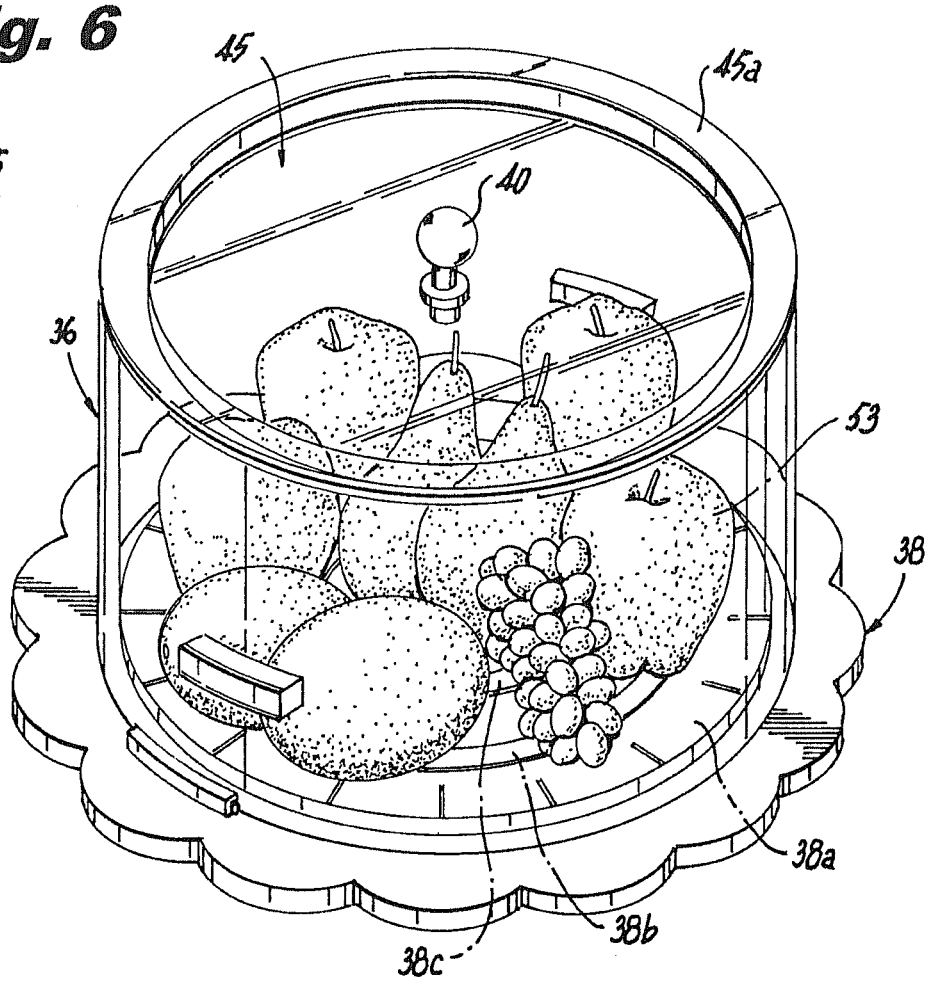
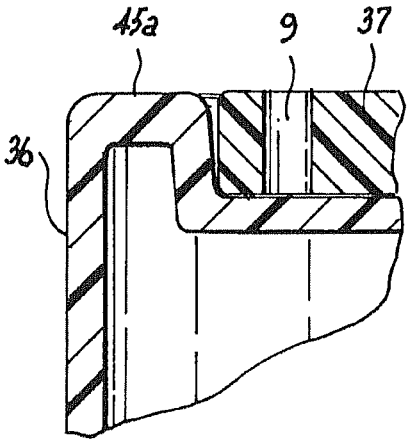
Fig. 7
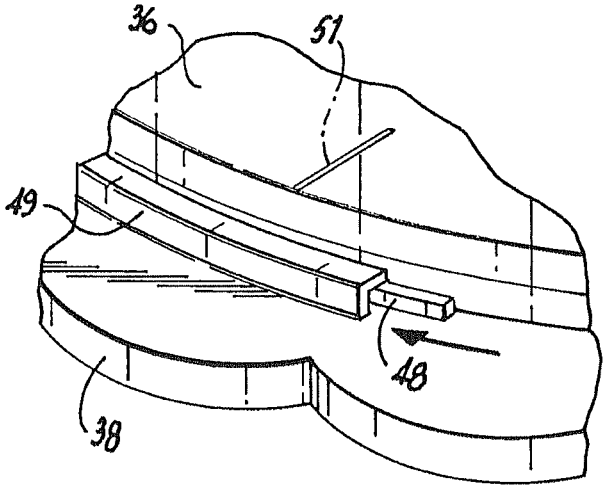
Fig. 8

Fig. 9
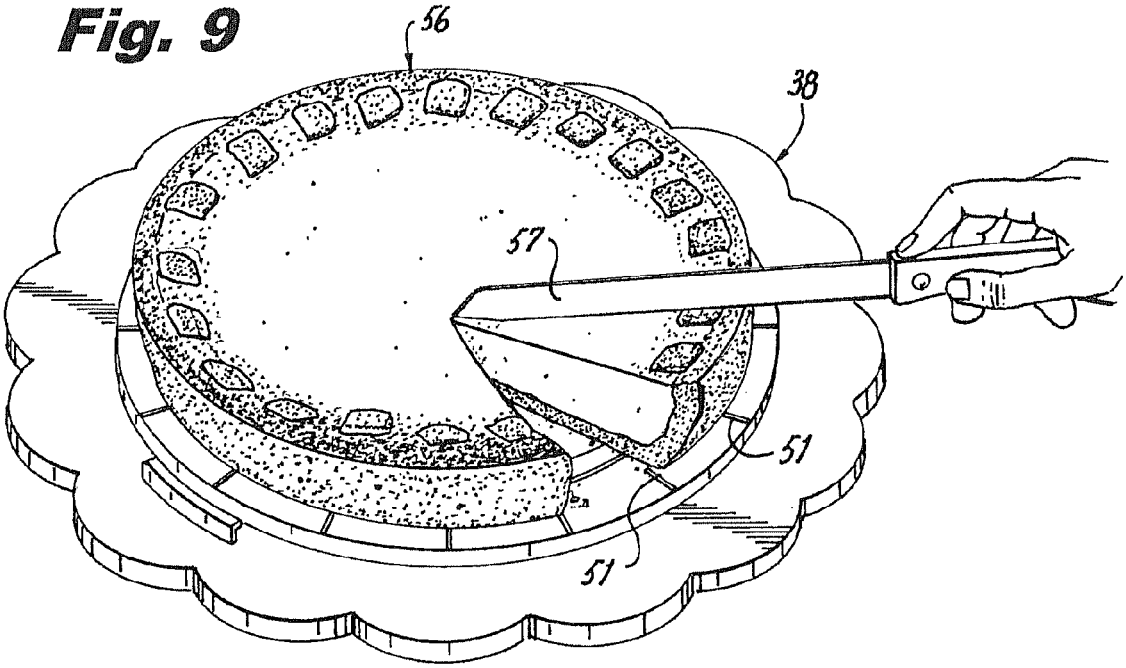
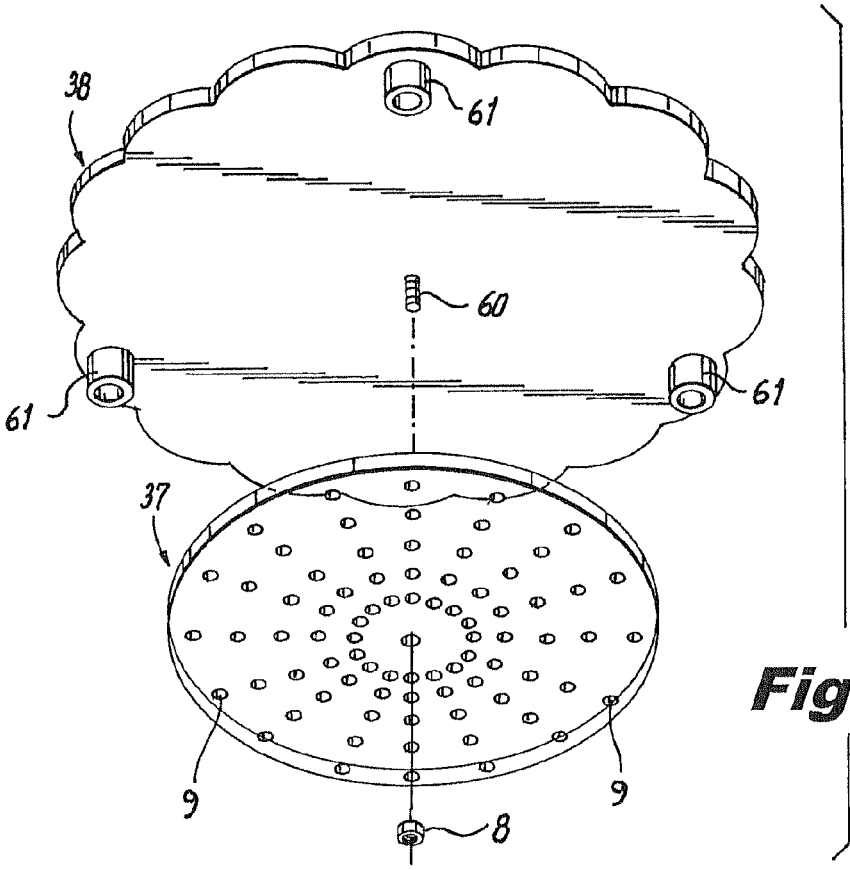
Fig. 10

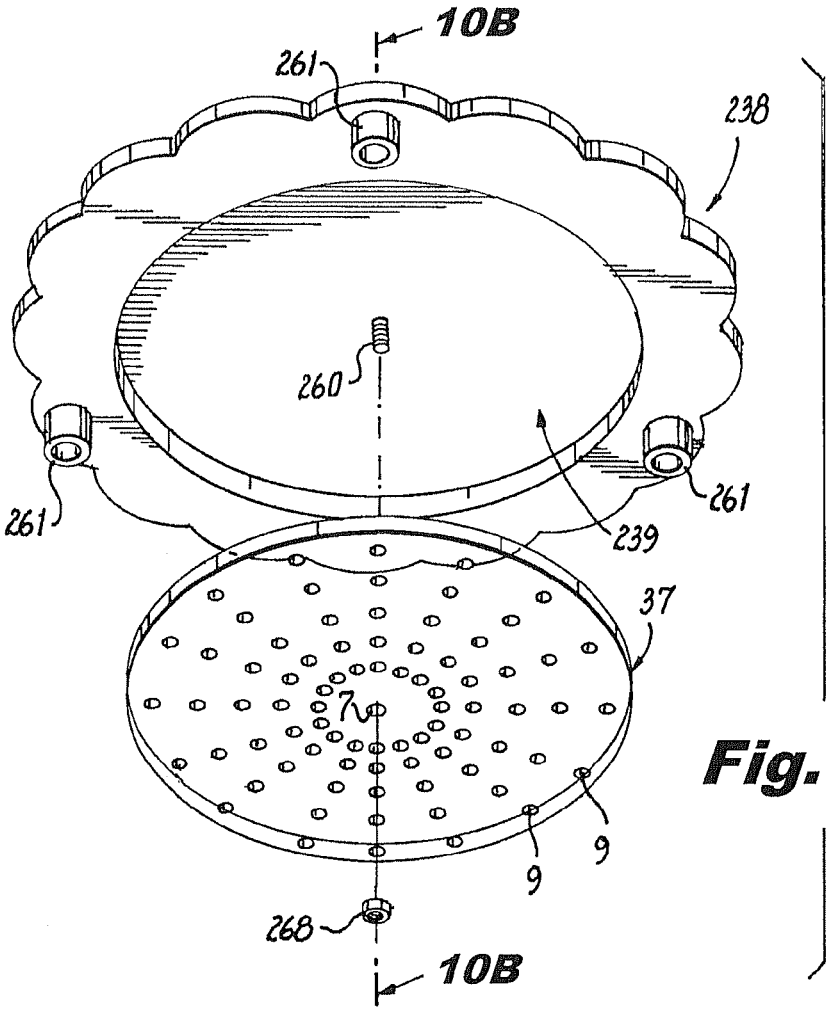
Fig. 10A
Fig. 10B
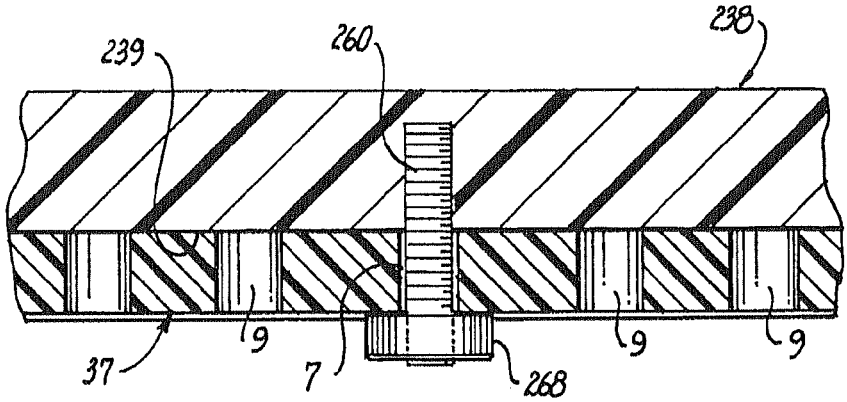

Fig. 15
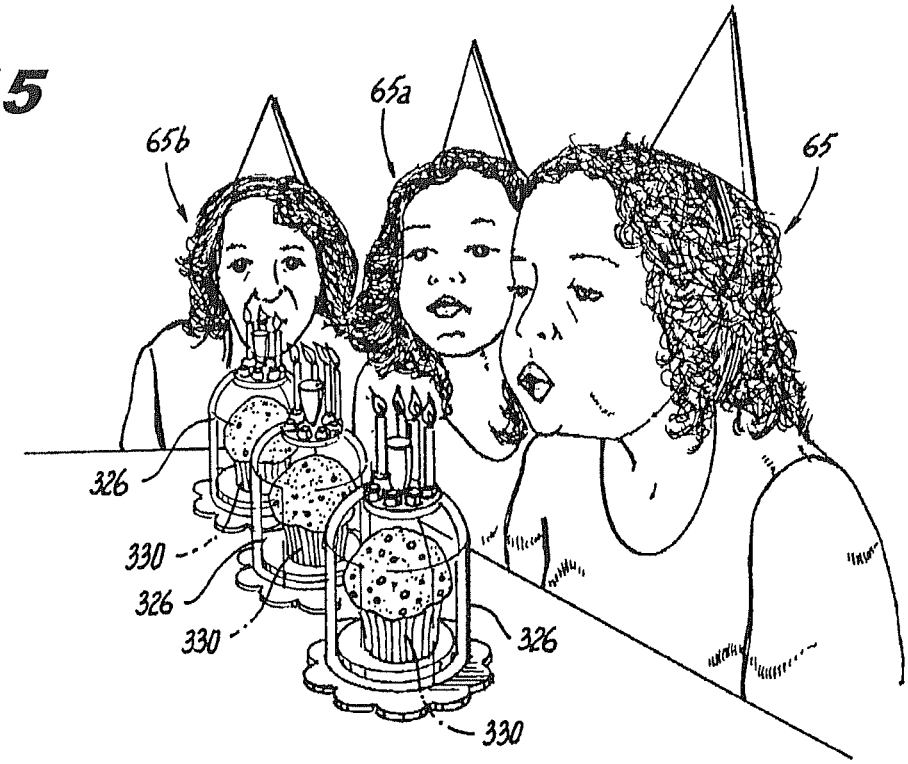
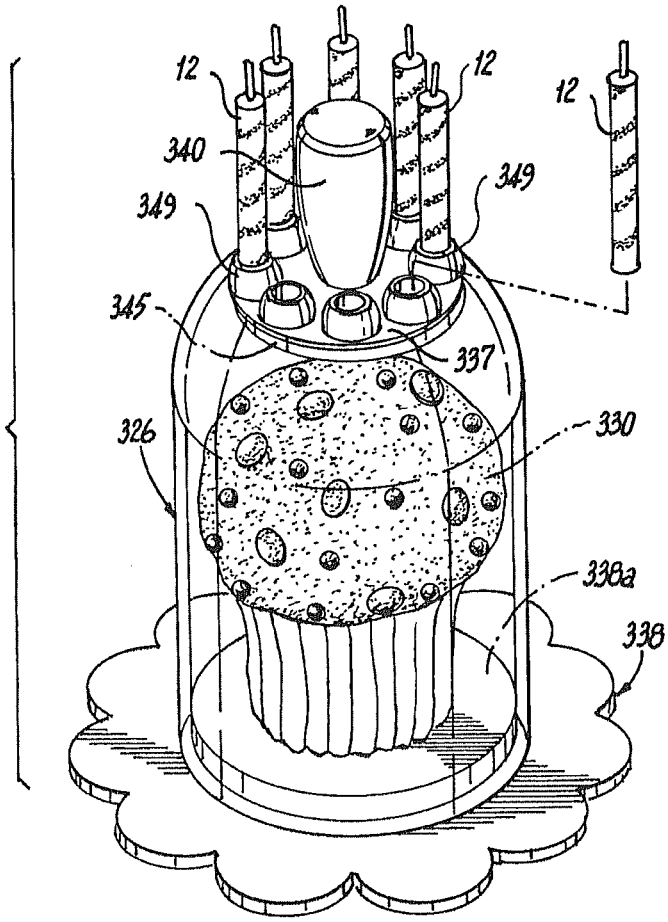
Fig. 16

SANITARY CANDLE COVERS FOR CAKES AND CUPCAKES

RELATED APPLICATIONS

This application is a continuation-in-part of my application Ser. No. 13/430,194, filed Mar. 26, 2012, and Applicant claims priority in part pursuant to 35 USC §120. Application Ser. No. 13/430,194 is based upon provisional applications 61/468,628 filed Mar. 29, 2011 and 61/475,302 filed Apr. 14, 2011, and claims priority therefore under 35 U.S.C. §119(e). These applications are incorporated by reference herein.

FIELD OF THE INVENTION

The present invention relates to transparent cake covers with removable candle decks which do not pierce the cake being decorated by candles.

BACKGROUND OF THE INVENTION

The age-old problem with birthdays and other occasions involving cakes with candles atop is one of sanitation relating to the task of blowing out the candles. When the celebrant blows out the candles, the liquid wash which emanates from his or her mouth descends upon the cake possibly infecting it with a deluge of germs, fluids, and perhaps other debris. The tradition of substituting multiple cupcakes for the cake at such celebrations is becoming more popular. They substituting multiple cupcakes for the cake at such celebrations is becoming more popular. They are often grouped in a cluster with one candle on each cupcake wherein the celebrant proceeds to blow out the candles with similar unsanitary exposure.

This sanitary problem with candle-blowing atop cakes has been explored by several patents in the prior art. Carlson, with his birthday cake cover with base, of U.S. Pat. No. 2,758,458, deals with the problem by providing a circular cake cover with slightly domed top surface having a pattern of recesses for candles and a central knob. The cover is securely latched onto the base.

The birthday cake cover and candle holder of Barfus (U.S. Pat. No. 4,721,455) is supported by a stake into the cake and covers the top surface only, thereby offering little protection to the side of the cake. The cake protector of MacKendrick (U.S. Pat. No. 3,819,455) includes a central dome shaped section with integral candle holders and a lower flange which rests on the top surface of the cake. The sides of the cake are protected by a collar with inwardly directed upper flange and an outwardly directed lower flange. In operation, the collar is lowered onto the central dome wherein the upper flange rests on the lower flange of the dome section, while the lower collar flange rests on, or is close to, the supporting surface.

The cake cover of Mc Birnie (U.S. Pat. No. 3,736,214) includes several parts. Four stakes with flat tops are forced into the top surface of the cake. They support a rigid transparent disk slightly larger than the cake diameter. A transparent flexible sheet is then draped over the disk; a second transparent disk of similar size is then placed atop the sheet. Separate candles in holders with flat bottoms are then placed atop the top disk. If the sheet is a woven fabric, the protection of the side of the cake is in some jeopardy. The fragility of separate candles in holders is a safety concern.

Wexler's cake cover and candle holder (U.S. Pat. No. 4,938,688) uses a thin vacuum formed transparent plastic cover with sloping sides and flat top with integral candle indentations to cover a cake. Wexler's protective cake cover and candle holder (U.S. Pat. No. 4,884,966) also is based on the use of a vacuum formed plastic cover, but it now also uses tubular standoffs on the cake icing separating the top cover surface from the cake top. Besides having candle indentations, the top surface also can use these indentations as cutting guides by marking the top of the cake.

The prior art does not reveal a protective transparent cover for a cup cake with a candle holder atop. Also, the prior art does not reveal a transparent cake cover with a removable candle deck to permit dual-use as a fruit, cheese, or other food container with an unobstructed view, while at the same time, avoiding piercing of any part of the cake when used with a cake and a candle deck.

OBJECTS OF THE INVENTION

It is therefore an object of the present invention to provide a sanitary cake cover with a removable candle deck, which protects the contents of the cake from contamination during blowing out of celebratory lighted candles.

It is also an object of the present invention to provide a transparent cake cover with a removable candle deck, which does not pierce the cake being decorated by celebratory lighted candles.

It is also an object of the present invention to provide a cake cover which has a removable candle deck, wherein the cake cover can be used without the candle deck.

Other objects which become apparent from the following description of the present invention.

SUMMARY OF THE INVENTION

In keeping with these objects and others which may become apparent, the present invention is a sanitary cake cover which is a dual-use container, which houses a cake of a geometric shape, such as round, rectangular or fanciful (i.e. football, shamrock, cartoon character or organizational logo) shape in a transparent housing impervious to assault by normal airborne contaminants, such as dust and dirt as well as that from contaminated, microbe infiltrated, expelled breath, during the act of blowing out candles.

A separate removable candle deck with through holes 3 or, non-through holes, for holding candles, which can be attached to or nestled securely atop the cover, is used to enable the container to be used for display and storage of other food items without the obstruction of candle recesses. The flat top of either a round, rectangular or other shaped cover has a peripheral top ridge forming a flat central recess of dimensions to fit the flat candle deck. The candle deck can be optionally stored underneath the flat base when not in use. In a further option, the flat base platter can have a recess on its underside, for storing the candle deck within the recess and which is held in place by a fastener.

In another embodiment, a transparent cover with a cylindrical side and a hemispherical domed top is used as a cupcake cover to cover a small, individually baked cupcake. The center of the dome has a hole accepting a bottom extension of a decorative ferrule with a candle recess in its center. This offers equivalent protection for a cupcake as the sanitary cake cover offers to a cake during a candle-blowing ceremony. In a preferred embodiment, the cupcake cover includes a candle deck interchangeable with a knob for the preferably domed shaped cupcake cover, where the candle deck, (which optionally can be stored below the platter) is nested in a recess at the top of the cupcake holder during candle lighting use. The domed cupcake cover can optionally be open at the bottom for resting over a cupcake placed on a tabletop, where the bottom peripheral edge of the cupcake cover rests on the table.

The cake cover embodiment is available with several variations. First, the transparent cylindrical, rectangular or other shaped cover can just be supported by a flat base. Alternatively, a round cylindrical cover can optionally have engagement members which mate with and lock into recesses on the base.

By the word, "cake," covered by the cover and candle deck herein, it is assumed to be a monolithic, large cake of any configuration, a plurality of pre-sliced cake slices organized as a cake or as individual slices, or one or more cupcakes.

The base can optionally be enhanced with indicia which extend beyond the circumference of a cake, as a guide to cutting standard sized slices. The bottom of the base of the cake cover, either for a full sized cake or for an individual cupcake, can have a plurality of support legs (such as three) raising it off a support surface, such as a table, and providing space for storage of the candle deck when not in use. A central knob can be attached through a hole in the cover or by other fastener means by threaded extensions, or by a press fit, with or without the candle deck in use. This knob is also preferably used to attach the candle deck to the cover.

The candle deck can also be used unattached to the cake cover or cupcake cover, with or without a central knob. In this variation, the flat depressed surface within the peripheral edge ridge of the cover top need not have a central hole to receive a screw thread or other fastener, thus resulting in a more appealing unobstructed view for dual-use service as a food item container.

In a further embodiment, the candle deck can be a set of candle holders extending from a top or bottom surface of the candle deck, where void spaces are provided between the candle holders to reduce the weight and manufacturing cost of the candle deck, whether the candle deck is used on a large cake or a small individual cupcake.

BRIEF DESCRIPTION OF THE DRAWINGS

The present invention can best be understood in connection with the accompanying drawings. It is noted that the invention is not limited to the precise embodiments shown in drawings, in which:

FIG. 6 is a perspective view of the sanitary cover of FIG. 4 housing fruit as in a dual-use configuration without a candle deck;

FIG. 7 is a close-up detail view in cross section of the top edge of the cover and the candle deck taken along view line "7-7" of FIG. 4, when viewed in the direction of the arrows depicted therein;

FIG. 8 is a close-up detail perspective view of the respective lock members of the cover and the base as shown in the dashed circle line "8" of FIG. 4;

FIG. 9 is a perspective view of a knife guided by the indicia on the base being used to cut a slice of cheesecake;

FIG. 10 is a bottom perspective view of the base of the sanitary cover of FIG. 4, showing three legs and the method of storing the candle deck flush against a bottom of the platter base;

FIG. 10A is an exploded bottom perspective view of the base of the sanitary cover of FIG. 4, showing three legs and the method of storing the candle deck within a cut out counter sink recess in the bottom of the platter base;

FIG. 10B is a crossectional detail view of the embodiment shown in FIG. 10A, showing the candle deck stored within the recess of the platter base and held in place by a fastener.

FIG. 15 is a perspective view of a group of children, each with a respective cupcake with groups of candles, in an embodiment for a deck placed over a cupcake cover;

FIG. 16 is an enlarged perspective view of the preferred embodiment for a cupcake cover of FIG. 15, with a candle deck held within a recess on top of the cupcake cover, where the candle deck is removable and storable under a base platter for the cupcake and cupcake cover;

DETAILED DESCRIPTION OF THE INVENTION

Figure 1:
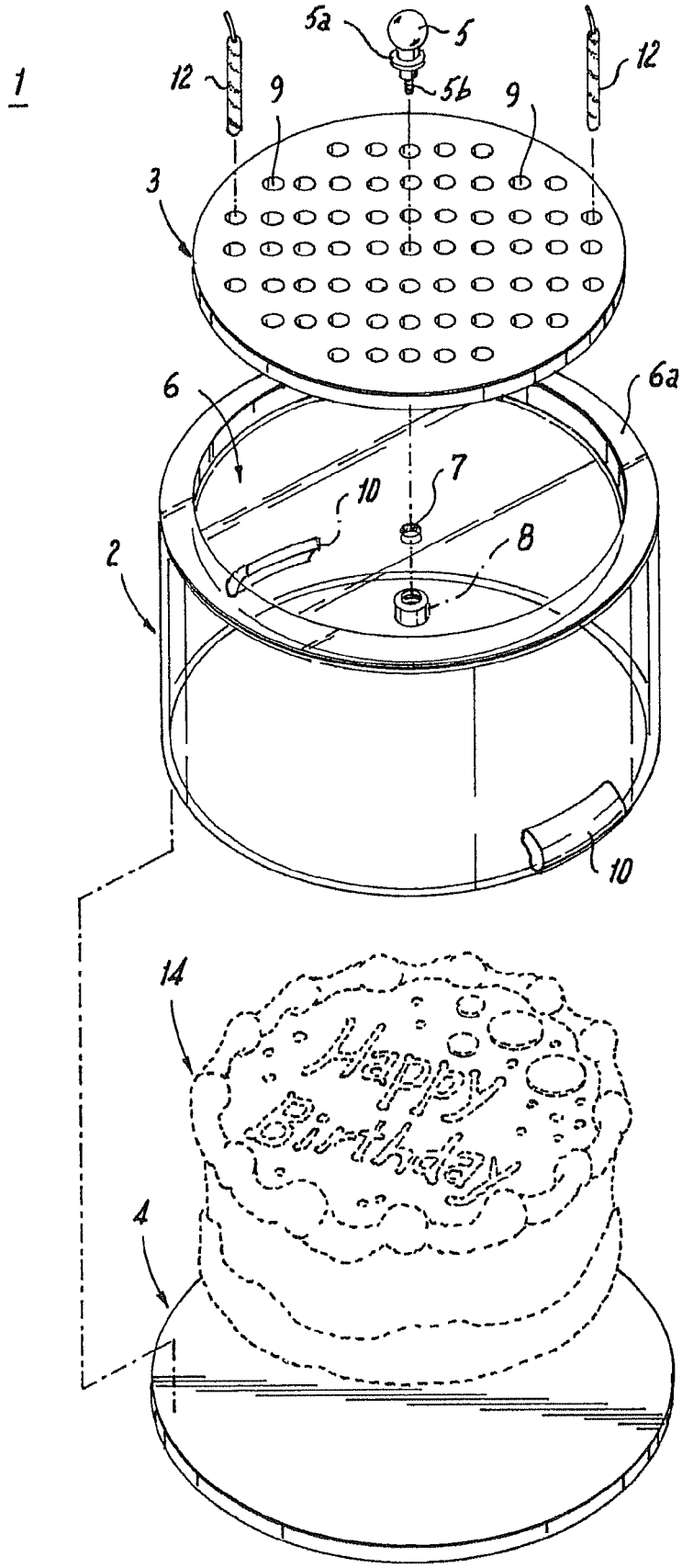
FIG. 1 is an exploded perspective view of the first embodiment for the sanitary cake cover of this invention with a candle deck, attachment knob, cover, round birthday cake and plain base.
Figure 2:
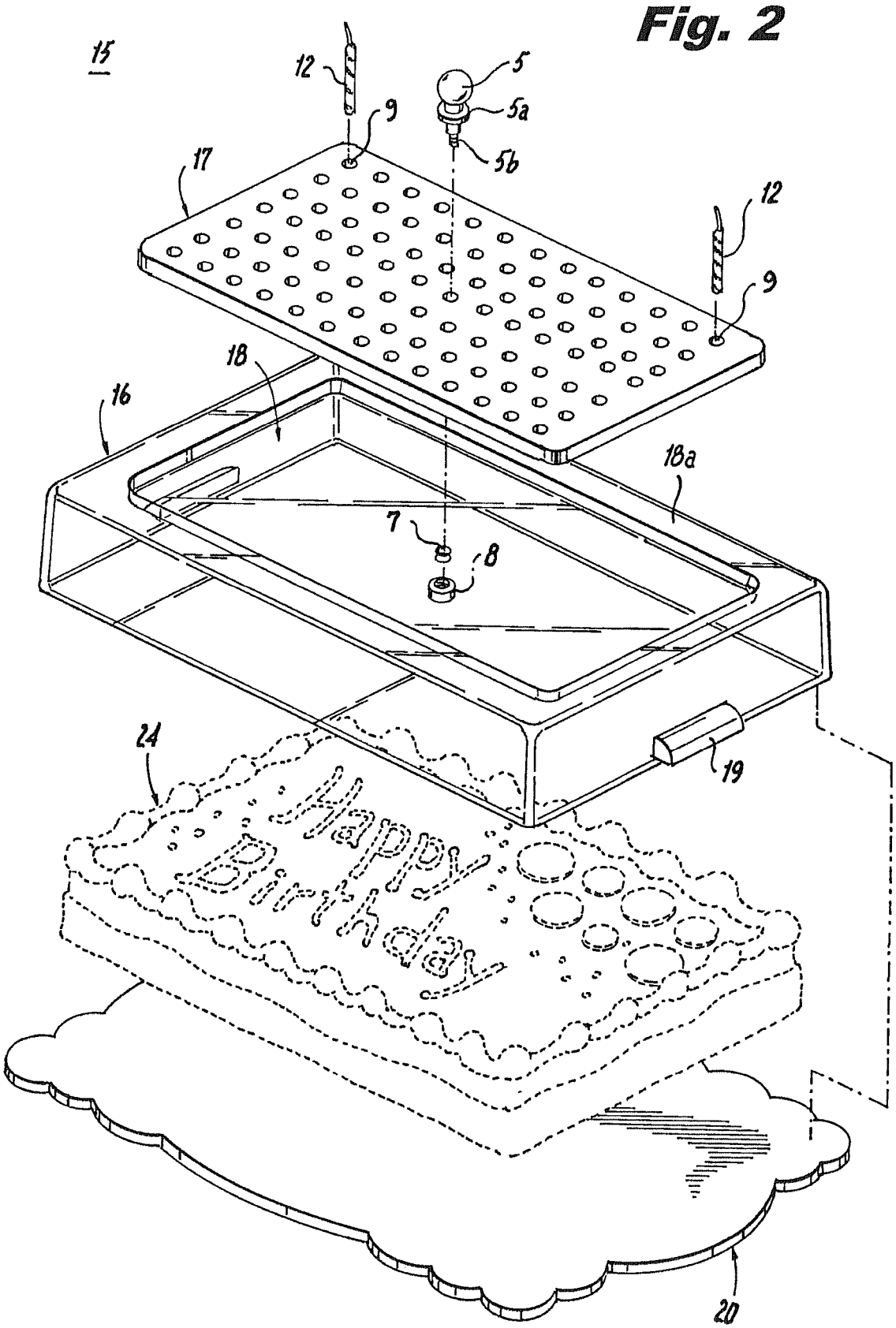
FIG. 2 is an exploded perspective view of the second embodiment for the sanitary cake cover of this invention for a rectangular cake, such as a "sheet cake", showing the equivalent features as in FIG. 1.

FIGS. 1 and 2 each show a transparent sanitary cake cover assembly (designated by reference numerals 1 or 15) of this invention with a removable candle deck for a round cake and for a rectangular cake respectively.

In FIG. 1, cover 2 is a round transparent cover with top edge peripheral ridge 6*a* and flat depressed region 6. Cover 2 has optional lift handles 10 and a fastener means, such as a central hole 7 to accept the screw extension 5*b* below flange 5*a* of knob 5, which fits through central hole 7 in removable candle deck 3 and attaches deck 3 to cover 2 via a fastener, such as nut 8 on the underside of depressed region 6. Round cake 14 is supported by plain base 4, and candles 12 populate some of grid holes 9 in candle deck 3. Grid holes 9 can be through holes extending all the way through candle deck 3, or can be partial recess holes with closed bottoms, extending into, but not all the way through, candle deck 3.

FIG. 2 shows transparent sanitary cake cover assembly 15 for rectangular cake 24 which is supported by plain base 20. A rectangular cover 16 with optional handles 19, central hole 7, and depressed region 18, which supports rectangular removable candle deck 17 therein, when candle deck 17 is surrounded by upwardly extending peripheral ridge 18*a* of rectangular cover 16.

While FIGS. 1 and 2 show round and rectangular shapes for the transparent cover and cake therein, it is understood that other shapes for the transparent sanitary cake cover and cake itself may be used, for example, including other geometric shapes (i.e. triangles or ovals, etc.), or fanciful shapes (i.e. football, shamrock, cartoon character or organizational logo).

Figure 3:
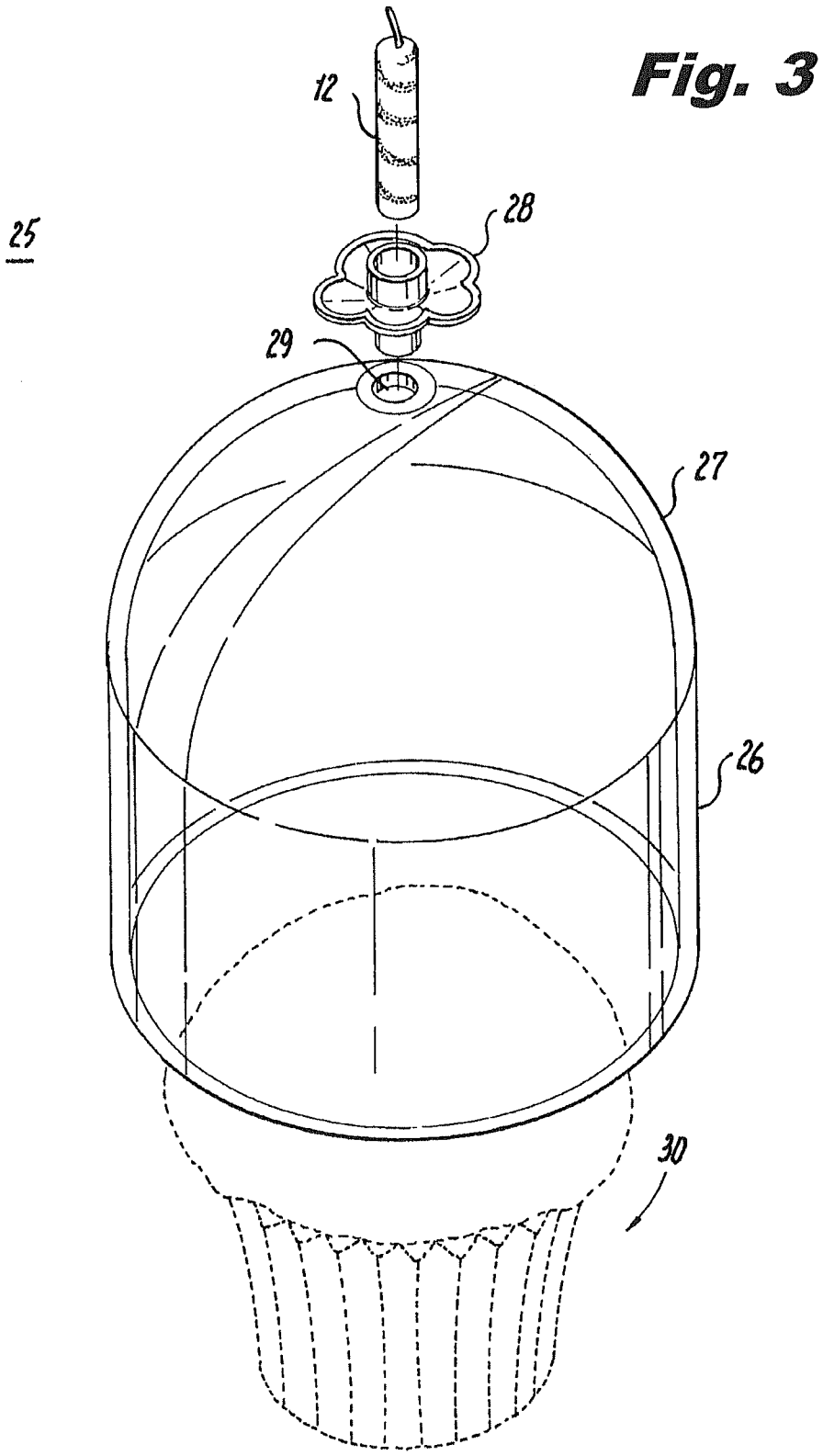
FIG. 3 is an exploded perspective view of a third embodiment for a domed sanitary candle cover of this invention for a cup cake.

FIG. 3 shows the alternate embodiment for sanitary cover 25 for cup cake 30. It has a transparent cylindrical side 26 with dome top 27. Hole 29 accepts ferrule 28 snugly which has a recess for candle 12 on top.

Figure 4:
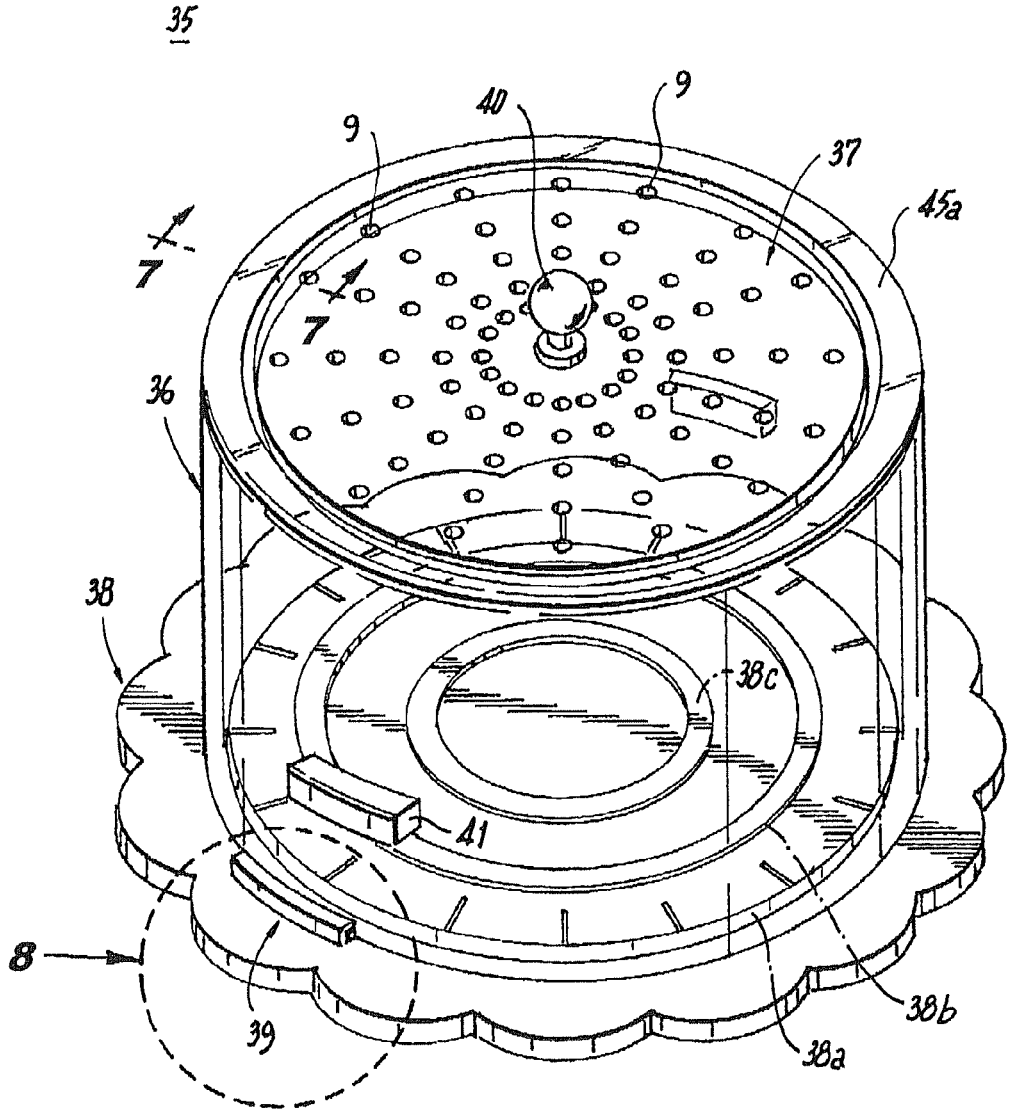
FIG. 4 is a perspective view of a fourth embodiment for a sanitary cover with an optional decorative starburst designed candle deck for a round cake; wherein the cover locks into the base.

FIG. 4 shows several alternate embodiment variations for a sanitary cake cover assembly 35, which differs from sanitary cover 1, which include sanitary cover 36. Cover 36 locks into base 38 via two engaged locks 39. Handles 41, which are optionally removable, can be used for lifting in lieu of knob 40. Removable candle deck 37 with a starburst pattern, or other array pattern, of candle holes 9 is attached to the top recessed region of plate cover 36 by fasteners, such as knob 40. While base 38 shows cake-supporting pedestal plate 38*a* with concentric cake support rings 38*b*, it is known that, optionally, base 38 can be flat with no pedestal and/or rings.

FIGS. 5-11 show more details of the sanitary cake cover assembly 35.

Figure 5:
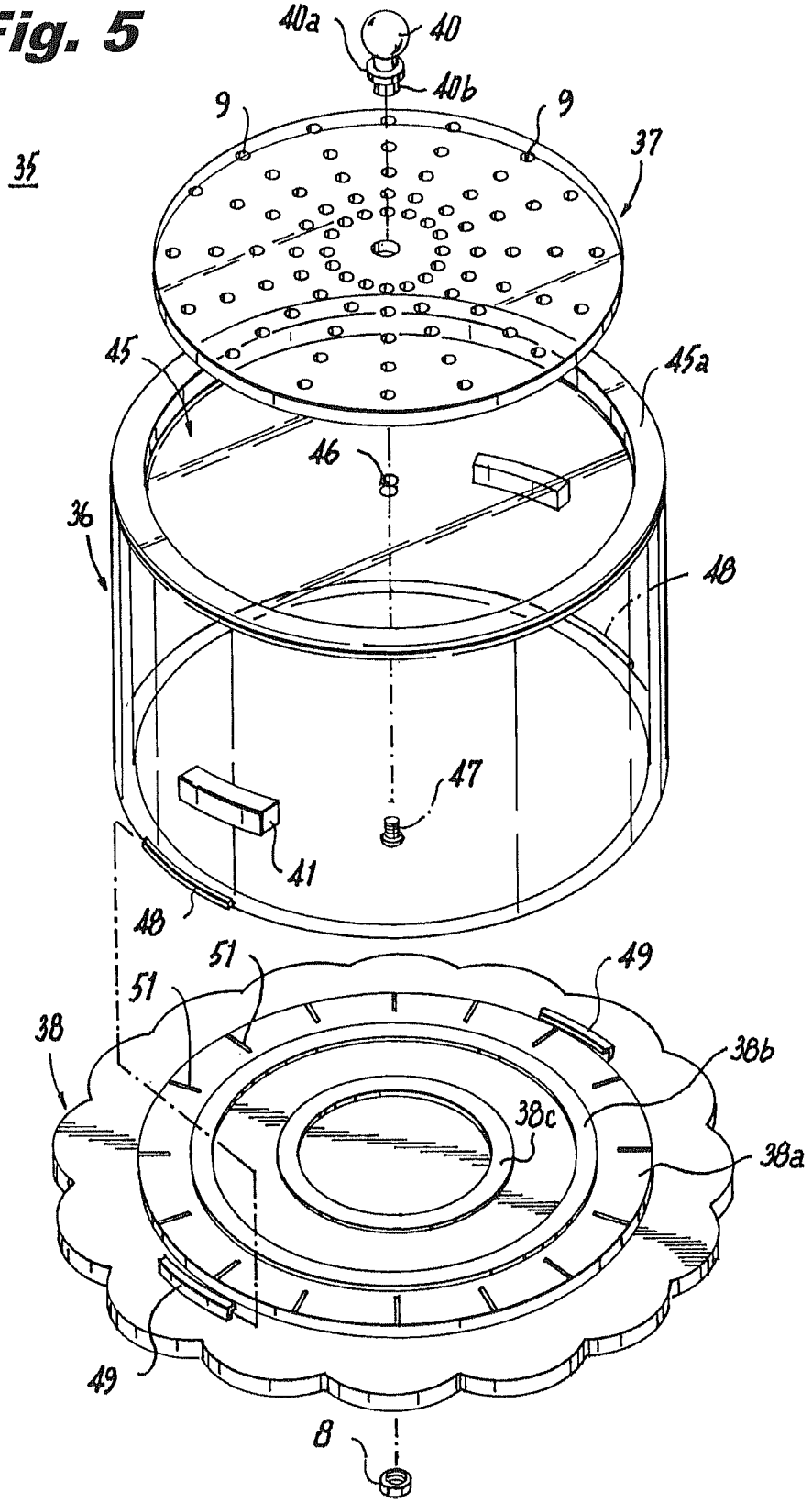
FIG. 5 is an exploded perspective view of the sanitary cover of FIG. 4 more clearly showing the base indicia to guide slice cutting.

In contrast to FIGS. 1 and 2, where the fasteners for knob 5 has threaded stem 5*b* extending below flange 5*a*, through candle deck 3 and hole 7 of cover 2, in the exploded view of FIG. 5, a fastener, such as screw 47, enters through the bottom of central hole 46 in recessed region 45 of cover 36, with peripheral ridge 45*a*, to attach candle deck 37 via the threaded hole in the bottom stem 40*b* of knob 40, above flange 40*a*. Also shown in FIG. 5, optional external protrusion 48 of transparent cover 36 enters recess 49 on base 38, to lock transparent cake cover 36 to platform base 38. Optional indicia 51 are guides for cutting uniform cake slices.

FIG. 6 shows transparent sanitary cover 36 to house fruit 53. It is noted that knob 40 used without candle deck 37, which has been removed.

FIG. 7 shows crossection the detail at the edge of the top peripheral ridge 45*a* of cover 36, with candle deck 37.

FIG. 8 shows a detail view of the engagement of lock housing 49 on base 38 and protrusion 48 extending from cover 36, by rotating cover 36 relative to base 38, so that protrusion 48 of sanitary cover 36 rests within the confines of lock housing 49, such as, for example, below a ledge of lock housing 49.

FIG. 9 illustrates cutting uniform slices of cheesecake 56 by aligning knife 57 with indicia marks 51 which extend beyond the circumference of cake 56.

FIG. 10 shows the underside of platform base 38 with short legs 61 and a fastener, such as central screw stud 60, which secures candle deck 37 for storage of candle deck 37 under base 38, via a further complementary fastener, such as nut 8.

FIG. 10A shows a platter base 238 for the sanitary cover 36 of FIG. 4, showing a plurality of legs 261 and the method of storing the candle deck within a counter sink cutout recess 239 in the bottom of the platter base 238, whereby the recess 239 has a diameter closely equivalent to the diameter of the candle deck 37 for insertion therein, whereby the candle deck 37 is held in place by nut 268 engageable with threaded fastener extension 260 centrally located within recess 239. Holes 9 can be through holes extending all the way through candle deck 37, or can be partial holes with closed bottoms.

FIG. 10B shows the embodiment shown in FIG. 10A, wherein candle deck 37 is provided with candle holes 9 and central hole 7 having threaded extension 260 engageable with fastener nut 268, to hold candle deck 37 within recess 239.

It is further noted that while FIGS. 1 and 2 do not require storing the candle deck below the respective platters 4 and 20, it is assumed that platters 4 and 20 could be modified as shown in FIG. 10 to also store candle decks 3 and 17 thereunder, either flush with platters 4 and 20, similar to platter 38 of FIG. 10 or with an indented recess 239, as shown in platter 238 of FIGS. 10A and 10B.

Figure 11:
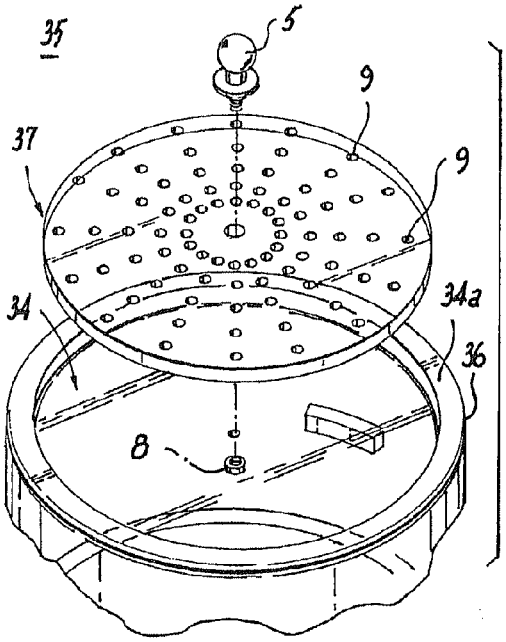
FIG. 11 is a top perspective detail showing a different knob used to attach the candle deck of FIG. 4, where knob has a threaded extension extending through the candle deck and through the top of the cover, where the threaded extension is engageable with a threaded fastener, such as a nut.

FIG. 11 is a detail view of transparent sanitary cover assembly 35 having transparent cover 36 with peripheral upper ridge 34*a*, and depressed recess 34, using knob 5 to secure removable candle deck 37 via nut 8.

Figure 11A:
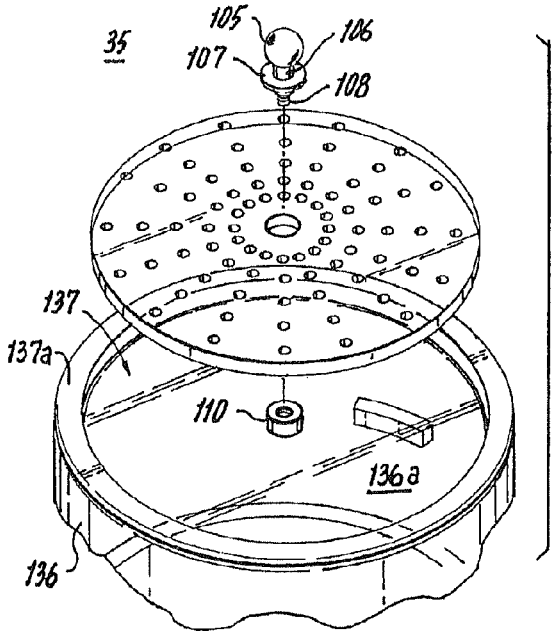
FIG. 11A is a top perspective detail showing a threaded stem knob engageable with an upwardly extending threaded boss, integrally formed with the top of the cover.

FIG. 11A shows an alternate embodiment where knob 105 has a finial or other grasping portion 105, having a stem 106, supporting a circumferential flange collar 107 above a threaded member 108, which engages a threaded upwardly extending boss 110 formed integrally with the top 136*a* of cover 136. Cover 136 has depressed recess 137 formed between the confines of upwardly extending peripheral edge rim 137*a* extending along a top peripheral edge of cover 136.

While FIG. 11A shows exterior threads on threaded stem 108 insertable within the internally threaded boss 110, it is also known that the opposite configuration can be used, where a stem on knob 105 has interior threads and the boss has exterior threads engageable therewith (not shown).

Figure 12:
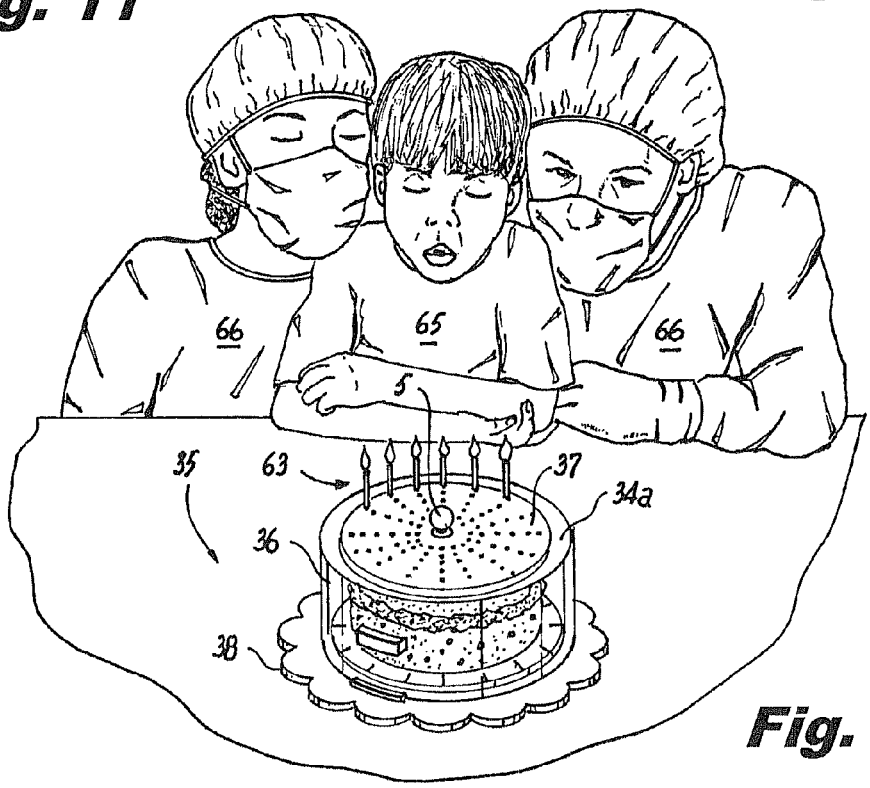
FIG. 12 is a perspective view of a child flanked by two healthcare providers blowing out candles on a cake enclosed in a cake cover of this invention, possibly in a hospital environment.

FIG. 12 illustrates a possible vignette for a sanitary cake cover assembly 35 with three human figures and a transparent sanitary cover protected cake with several lighted candles 63 on candle deck 37. The child 65 may have a transmitted disease, since he or she is flanked by two healthcare providers 66 wearing face masks. Child 65 can still safely blow out the candles. After the candle deck 37 is removed via knob 105 of FIG. 11A or by handles 83 of FIG. 14, and the surface of transparent sanitary cover 36 is thoroughly disinfected, transparent sanitary cover 36 can be opened, revealing a protected cake.

Figure 13A:
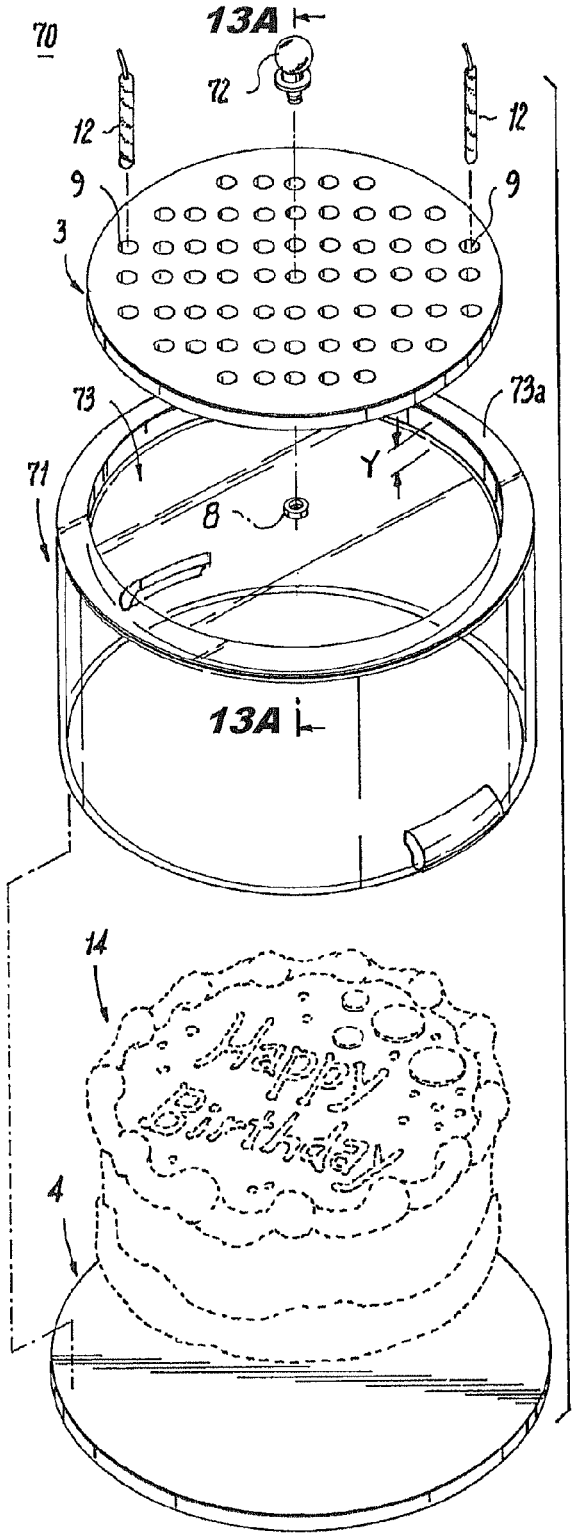
FIG. 13A is a central side detail crossection of the cake cover of FIG. 13, taken along view line "13A-13A" of FIG. 13, showing the candle deck separated from the cover top by the thickness of a nut.
Figure 13:
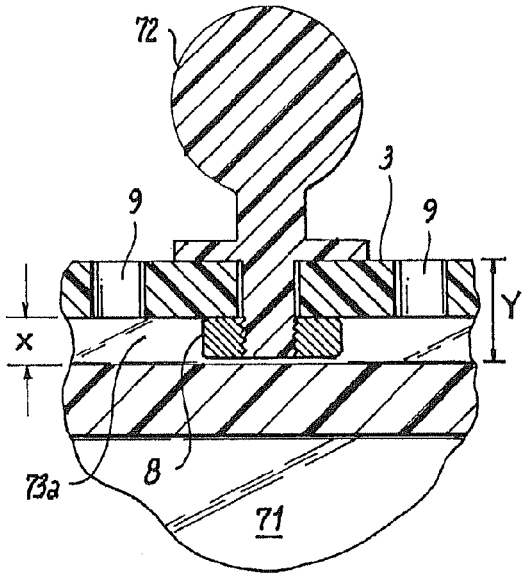
FIG. 13 is an exploded perspective view of a fifth embodiment for a cake cover wherein the candle deck is not attached to the cover but is nestled inside the top depressed area, wherein the peripheral edge ridge is deeper than the previous embodiments to accommodate the thickness of a fastener, such as an attachment nut.

Sanitary cover assembly 70, as shown in FIG. 13, shows an alternate embodiment for one variation with removable candle deck 3 unattached to transparent cover 71, where candle deck 3 nestles on top of depressed region 73 within a high edge ridge 73*a*. Note height of edge ridge 73*a* is "Y" as indicated.

FIG. 13A is a central side cross section detail through knob 72, showing removable candle deck 3, and recessed region 73*a*. It shows that knob 72 has a short threaded extension that is as long as nut 8 is thick, which is just slightly less than gap "X" as indicated. The total height of deck thickness plus gap "X" is equal to "Y", the height of ridge 73*a*. Note that recessed region 73 does not have a central hole. The draft angle of the edge ridge around deck 3 is an interference fit which keeps candle deck 3 level within gap "X". Therefore, candle deck 3 is not connected by a fastener to transparent cake cover 71, and is held in place by gravity within the recess 73, formed by the upwardly extending peripheral top ridge 73*a* of cover 71.

Figure 13B:
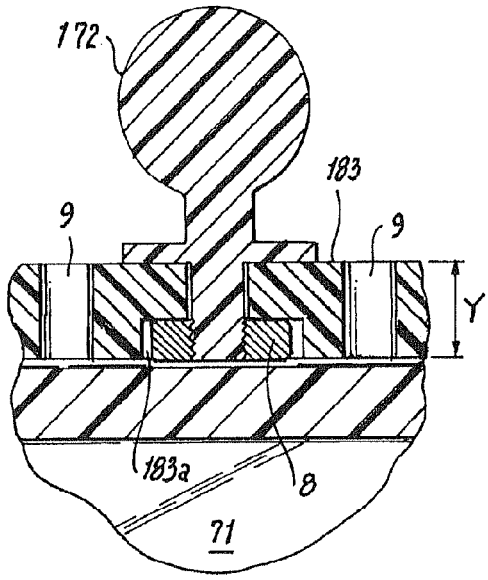
FIG. 13B is an alternate embodiment for a central side detail crossection of the cake cover of FIG. 13, showing the candle deck resting on the top of the cover, where the candle deck has a lower counter sink region to accommodate the thickness of a nut therein threadably engaging a threaded knob extension.

FIG. 13B shows an alternate embodiment detail in cross-section through knob 172, showing removable candle deck 183 with candle holes 9, and cover 71 having recessed region 73 and raised peripheral ridge 73*a* of FIG. 13. Knob 172 has a short threaded extension that is engageable with a nut 8, but where candle deck 183 has a countersink region 183*a* to accommodate nut 8, so that nut 8 does not extend below the bottom of candle deck 183, which sits in recess 73 upon the top of cover 71, which therefore has no holes in it, and is smooth all along its top surface edge between the confines of ridge 73*a*.

Figure 14:
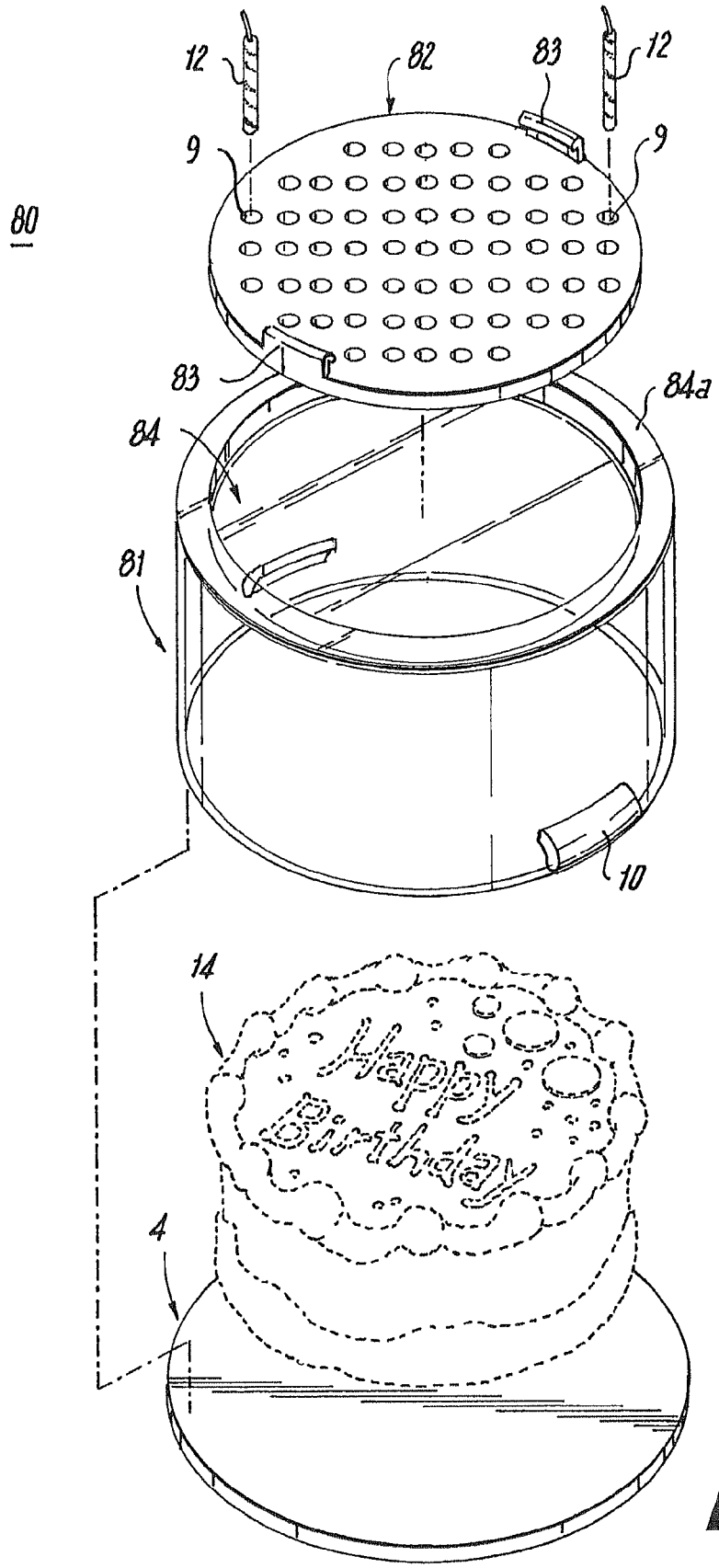
FIG. 14 is an exploded perspective view of a sixth embodiment for an alternate type of candle deck that is not attached to the cover, wherein it has recessed, optionally removable, side handles, instead of a central knob.

FIG. 14 shows a different variation of sanitary cover 80 assembly, also with an unattached removal candle deck 82, which has recessed handles 83 at the edge for lifting, and no central knob is used. Here again, recessed region 84 (which can have a recessed ridge 84*a* of less height than in FIG. 13) does not have a central hole. Candle deck 82 just rests atop recessed region 84 at the top of cover 81 when in use. The recess 84 diameter and ridge height are less critical in this variation. Handles 10 for carrying cover 81 are shown. Handles 10 can be permanently attached or molded to the side of cover 81, or cover handles 10 can be optionally removable when cover 81 is stored and not used.

Figure 14A:
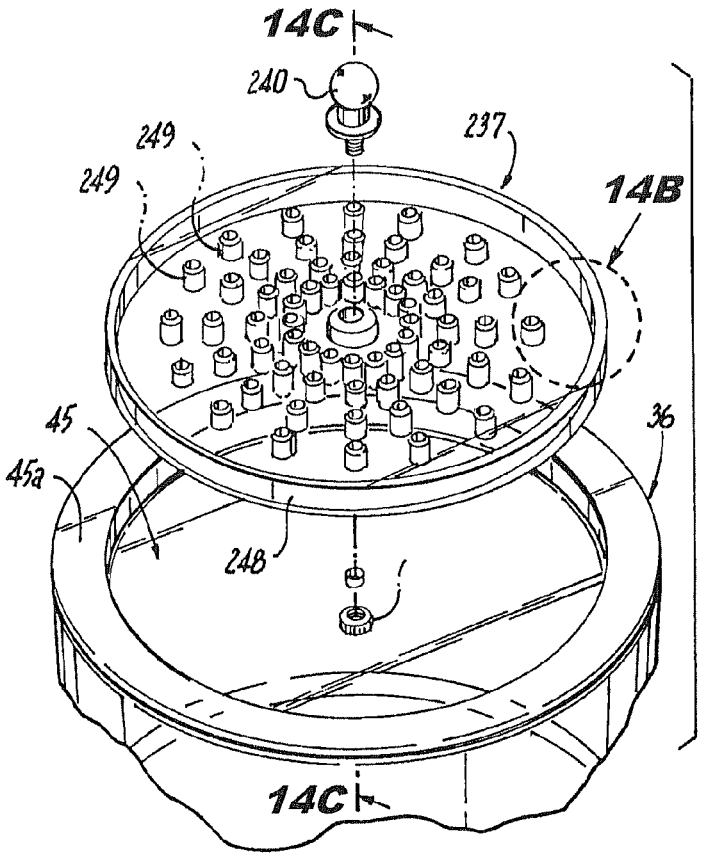
FIG. 14A is an exploded perspective view of a seventh embodiment for an alternate type of candle deck with void spaces surrounding candle holders, which may extend up or down from the surface of the candle deck, within the confines of a peripherally extending edge curtain.

FIG. 14A shows respective candle deck 237 that rests within upper recess 45 with peripheral edge 45*a*, but where candle holders 249 extend upward or downward from a surface of candle deck 237, within a void area 247, located within the confines of peripherally extending edge curtain 248 of candle deck 237.

Figure 14B:
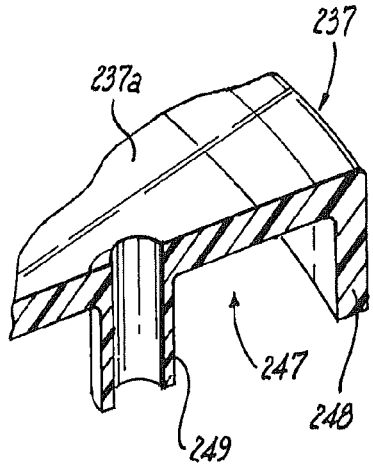
FIG. 14B is a crossectional detail view of the embodiment shown in FIG. 14A, taken along dashed view circle "14B" of FIG. 14A.

FIG. 14B shows a version of candle deck 237 having preferably cylindrical hollow candle holders 249 extending downward from a top 237*a* of candle deck 237, having peripherally extending edge curtain 248, defining a void area 247, into which candle holders 249 each extend into. Candle holders 249 can have through holes or partial, closed bottom holes.

Figure 14C:
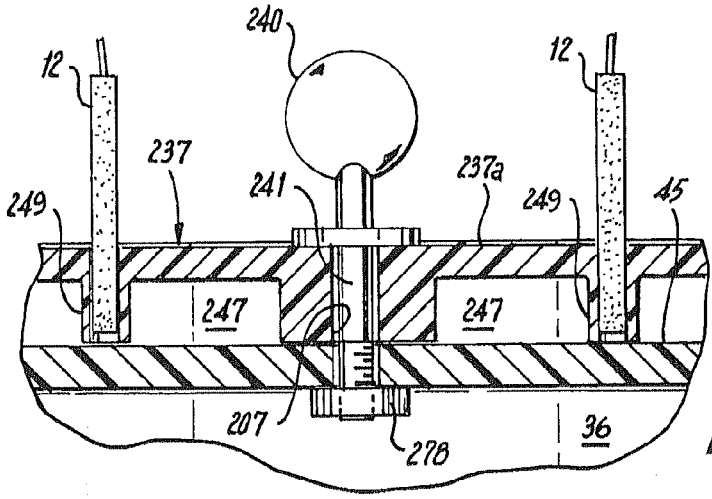
FIG. 14C is a crossectional detail view of the embodiment shown in FIG. 14A, taken along view line "14C-14C" of FIG. 14A, showing candles with respective candle holders, such as for example, with through holes or non-through holes for insertion of candles therein, and a knob with an extension attached to a threaded nut to the top of the cake cover.
Figure 17:
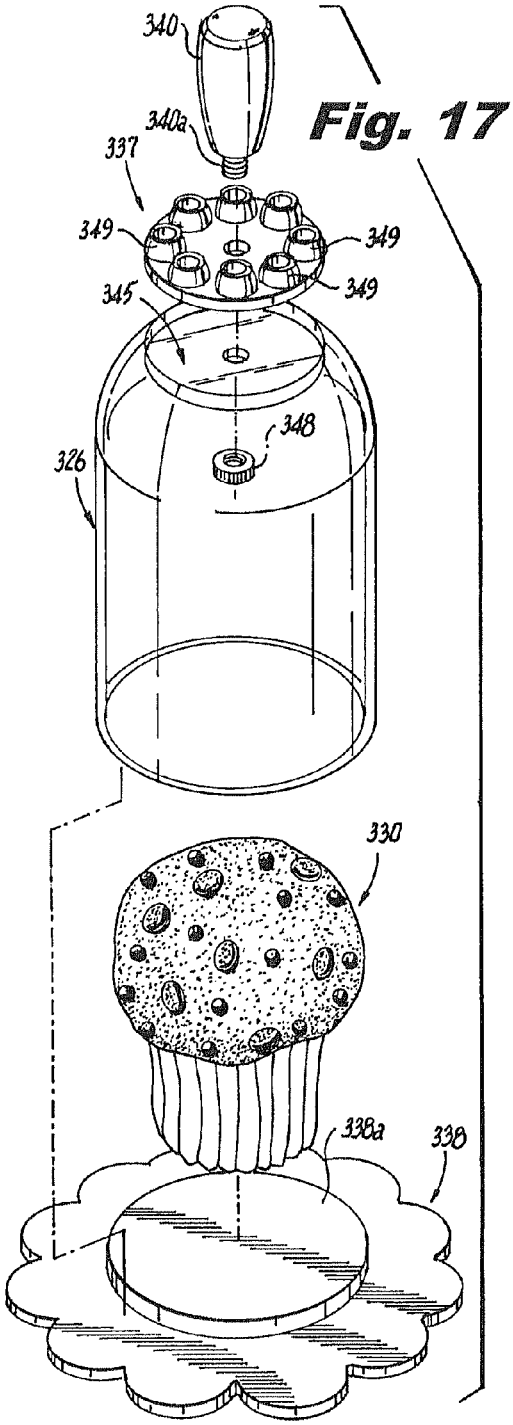
FIG. 17 is an exploded perspective view of the cupcake cover embodiment of FIG. 16.

FIG. 14C shows candles 12 being held in place for lighting within respective candle holders 249 extending from top 237 of candle deck 237, whereby knob 240 has an extension 241 extending into central hole 207 and engageable with threaded fastener 278, to temporarily hold candle deck 237 with recess 45 of cover 36.

FIGS. 15, 16, 17 and 18 show three children at a birthday or other party, where each child 65, 65*a*, 65*b* has their own respective domed or otherwise shaped cupcake cover 326, covering respective cupcakes 330, wherein further a candle deck 337 holds candles 12 within optionally beveled candle holders 349 extending up or down from candle deck 337, which may optionally have through candle holes or non-through holes extending from deck 337 through beveled candle holders 349. Cupcake cover 326 further includes a top recess 345 to hold candle deck 337 therein. Knob 340 attaches candle deck 337 to the top recess 345 of cupcake cover 326 via extension 340*a*. Platter base 338 supports cupcake cover 326 thereon. Knob 340 has threaded extension 340*a* engageable with fastener 348, such as a threaded nut.

Optionally, platter base can be flat, or else adorned with cupcake support pedestal plate 338*a*. As a further option, the candle deck can be a flat plate with holes similar to rounded deck 3 of FIG. 1.

Figure 18:
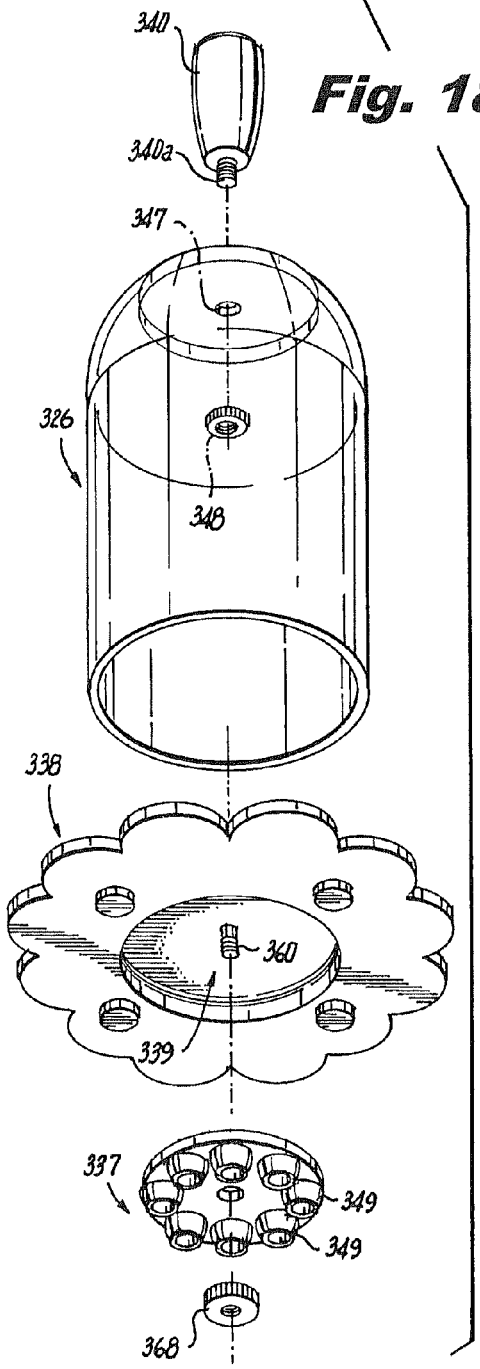
FIG. 18 is an exploded perspective view of the cupcake cover embodiment of FIG. 17, but showing the ability to stow the deck under the base platter, and to use the embodiment to keep a cupcake item fresh.

FIG. 18 shows the ability to stow the deck 337 within recess 339 under the platter base 338, and to use the embodiment to keep an item fresh.

Figure 19:
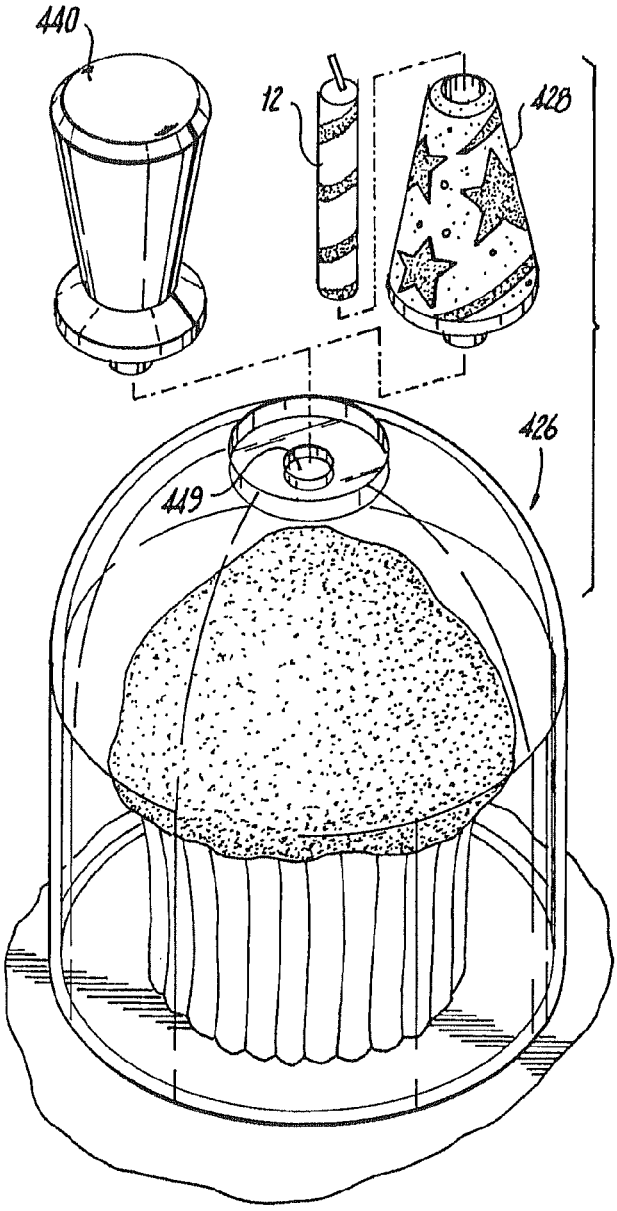
FIG. 19 is a perspective view of a ninth alternate cupcake cover embodiment, wherein there is no platter, and the knob and ferrule are friction-fitted into the cover aperture.

Also, while FIG. 16 shows a base platter 338 for storage of the candle deck 337 therein, FIG. 19 shows another alternate embodiment for a cupcake holder 426 with single candle 12, where there is no platter underneath the cupcake and the knob 440 and candle holding ferrule 428 are friction-fitted into the cover aperture 449.

Figure 20:
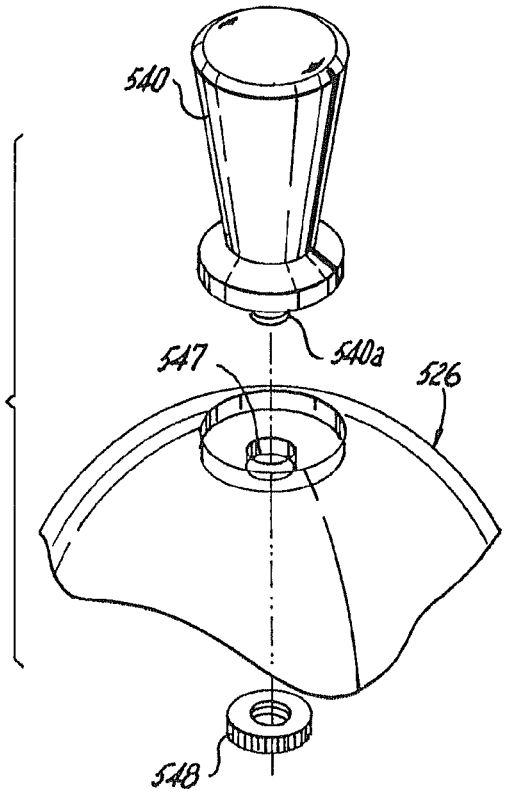
FIG. 20 is a close-up detail perspective view of a tenth alternate embodiment for a cupcake cover with a knob with a threaded extension engaging a nut below the domed cupcake cover; and, FIG. 21 is a perspective view of a cupcake cover similar to that of FIG. 19, but showing the cover having a molded collar for frictionally receiving the knob or ferrule, eliminating the aperture.

FIG. 20 shows a further alternate embodiment for a cupcake holder 526 with knob 540 with threaded extension 540*a* extending within through hole 547 and engaging a fastener 548, such as a nut, below dome cover 526. It is assured that a ferrule, such as ferrule 428 of FIG. 19 would be used, with a similar threaded mechanical arrangement similar to that of knob 340 having threaded extension 340*a* extending within through hole 547, for attaching to fastener, such as threaded nut 548.

Figure 21:
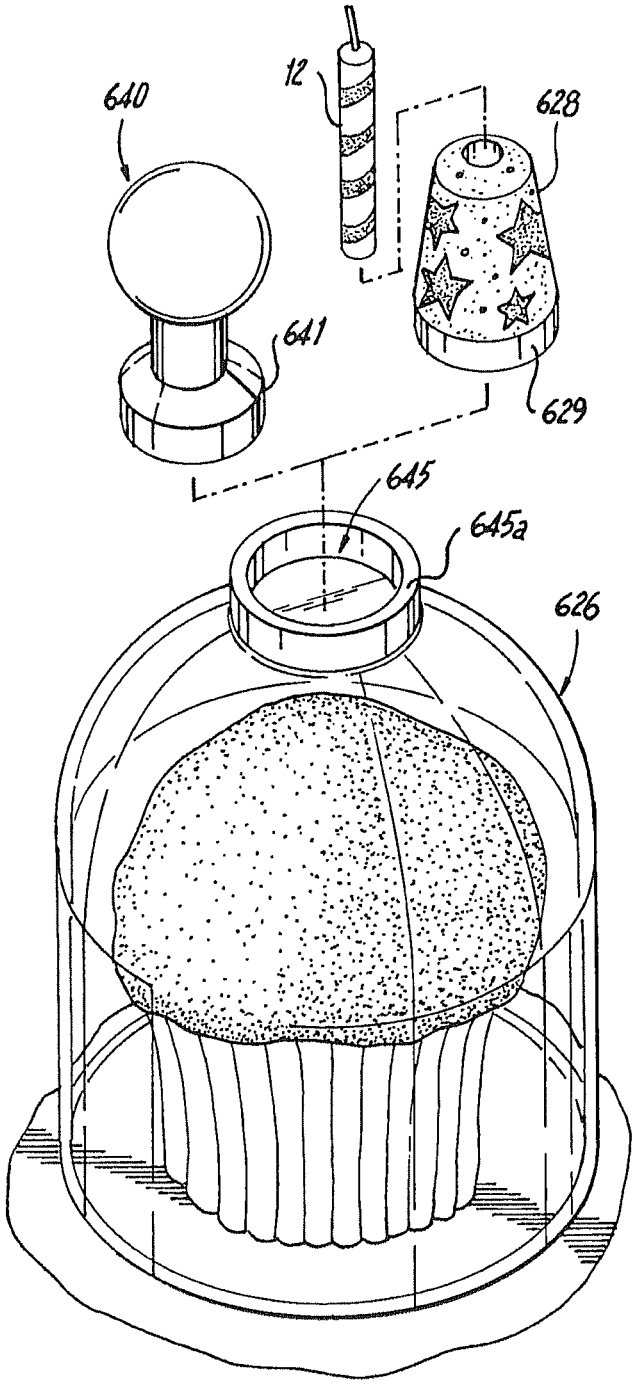

FIG. 21 shows cupcake holder 626, similar to cupcake holder 426 of FIG. 19, but showing the cover 626 having an upstanding molded collar 645*a* with recess 645 for frictionally receiving respective friction fit bases 641 and 629 of the knob 640 or ferrule 628 therein, thereby eliminating the need for central aperture 449 of FIG. 19.

While the aforementioned shows preferred embodiments, it is noted that other embodiments may be contemplated, as noted in the appended claims.

For example, in the foregoing description, certain terms and visual depictions are used to illustrate the preferred embodiment. However, no unnecessary limitations are to be construed by the terms used or illustrations depicted, beyond what is shown in the prior art, since the terms and illustrations are exemplary only, and are not meant to limit the scope of the present invention.

It is further known that other modifications may be made to the present invention, without departing the scope of the invention, as noted in the appended Claims.

I claim:

1. A sanitary cake cover dual use assembly comprising:

a protective transparent cover for a cake comprising a side wall and a top having a raised peripheral edge surrounding an area forming a depression in said top of said cover fully enclosing said cake, said transparent cover adapted to be impervious to assault by normal airborne contaminants, such as dust and dirt as well as that from contaminated microbe infiltrated, expelled breath during the act of blowing out candles;

a platform base supporting said cake within said cover;

a removable candle deck positioned within and not directly attached to said cover within said depression of said cover, said candle deck having at least one hole for insertion of at least one candle therein; and a knob having a portion thereof extending through said candle deck and removably connected to a bottom of said depression for lifting said cover along with said candle deck, whereby said candle deck is removable with either said cover or without said cover.

2. The sanitary cake cover dual use assembly as in claim 1 wherein said candle deck has a plurality of holes for insertion of an array of candles therein.

3. The sanitary cake cover dual uses assembly as in claim 1 wherein said platform base has a plurality of support legs providing a hollow space under said platform base for storage of said candle deck when not in use, said platform base having a screw stud extending down therefrom for securing said candle deck for storage of said candle deck under said base platform and having a further complementary fastener for engagement with said screw stud.

4. The sanitary cake cover dual use assembly as in claim 3 wherein said platform base has a recess on an underside thereof for storage of said candle deck therein.

5. The sanitary cake cover dual use assembly as in claim 1 wherein said candle deck includes a plurality of hollow candle holders extending from a surface of said candle deck, said candle deck having a vertically extending peripheral curtain wall with a void extending therein, in which said void, said hollow candle holders extend therefrom.

6. The sanitary cake cover assembly as in claim 3 wherein said transparent cover includes engagement members mating with, and locking, said transparent cover to said platform base.

7. The sanitary cake cover dual use assembly as in claim 3 further comprising said platform base extending beyond the circumference of a cake, said platform base having indicia as a guide to cutting standard sized slices of the cake.

8. The sanitary cake cover dual use assembly as in claim 1 wherein said transparent cover is round.

9. The sanitary cake cover dual use assembly as in claim 1 wherein said transparent cover is rectangular.

10. The sanitary cake cover dual use assembly as in claim 1 wherein said cover has a domed top portion.

11. The sanitary cake cover dual use assembly as in claim 1 wherein said transparent cover has a fanciful shape corresponding to a fanciful shape of a cake.

12. The sanitary cake cover assembly as in claim 6 wherein said lock engagement members of said cover comprise a protrusion extending from said transparent cover and a lock housing, wherein, by rotating said cover relative to said platform base, said protrusion rests within the confines of said lock housing.

13. The sanitary cake cover dual use assembly as in claim 1 wherein said candle hole penetrates through said candle deck.

14. The sanitary cake cover dual use assembly as in claim 1 wherein said candle hole partially penetrates said candle deck.

15. The sanitary cake cover dual use assembly as in Claim 1 wherein said knob has a threaded mechanical connection with both said candle deck and depressed area.

16. The sanitary cake cover dual use assembly as in claim 1 wherein said knob has a friction fit that fits within said depressed area of said cover.

17. A sanitary cake cover dual use assembly comprising:

a protective transparent cover for a cake comprising a domed top portion with a central hole therein and a side wall below said domed top portion fully enclosing said cake, said transparent cover adapted to be impervious to assault by normal airborne contaminants, such as dust and dirt as well as that from contaminated microbe infiltrated, expelled breath during the act of blowing out candles;

a raised peripheral edge surrounding a flat area forming a top depressed area in said top portion of said cover, said depressed area containing said a central hole;

a platform base supporting said cake within said cover;

a removable candle deck positioned within said top depressed area of said cover, said deck having at least one upwardly extending candle holder;

said candle deck having a central opening directly above said central hole; and a knob having a threaded extension extending through said central opening for engagement with said central opening for lifting said cover along with said candle deck whereby said candle deck is removable with or without said cover.

18. The sanitary cake cover dual use assembly as in claim 17 wherein said cake is a single cupcake.

* * * * *